US011806725B2

(12) United States Patent
Atkins

(10) Patent No.: US 11,806,725 B2
(45) Date of Patent: Nov. 7, 2023

(54) SYSTEM AND METHOD FOR REMOVING DEBRIS FROM A DRILLING FLUID

(71) Applicant: Schlumberger Technology Corporation, Sugar Land, TX (US)

(72) Inventor: James Edward Atkins, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/905,665

(22) PCT Filed: Mar. 8, 2021

(86) PCT No.: PCT/US2021/021284
§ 371 (c)(1),
(2) Date: Sep. 6, 2022

(87) PCT Pub. No.: WO2021/178943
PCT Pub. Date: Sep. 10, 2021

(65) Prior Publication Data

US 2023/0114032 A1 Apr. 13, 2023

(30) Foreign Application Priority Data

Mar. 6, 2020 (GB) ..... 2003288

(51) Int. Cl.
*B03C 1/02* (2006.01)
*E21B 21/00* (2006.01)

(52) U.S. Cl.
CPC ..... *B03C 1/02* (2013.01); *E21B 21/002* (2013.01); *E21B 2200/06* (2020.05)

(58) Field of Classification Search
CPC ..... E21B 21/002; C02F 1/481; B03C 1/02; B03C 2201/18
See application file for complete search history.

(56) References Cited

U.S. PATENT DOCUMENTS 3,637,033 A 1/1972 Mayall
4,611,615 A * 9/1986 Petrovic ..... F16L 55/24 210/695

(Continued)

FOREIGN PATENT DOCUMENTS

WO 2014109643 A1 7/2014
WO 2019240835 A1 12/2019

OTHER PUBLICATIONS

International Search Report and Written Opinion in International Patent Application No. PCT/US2021/021284, dated Jun. 18, 2021, 8 pages.

(Continued)

*Primary Examiner* — Robert E Fuller

(57) ABSTRACT

An internal assembly (230) for a tool (200) includes a retainer (232) that at least partially defines an axial bore (238). The retainer (232) further defines a port (246) providing a path of fluid communication from an exterior of the retainer to the bore (238). The internal assembly (230) also includes an electromagnet (250) coupled to the retainer (232). The electromagnet (250) is configured to actuate between an on state and an off state and to attract magnetic debris in a fluid when in the on state. The internal assembly (230) also includes a sleeve (260) that is configured to be positioned downstream from the retainer (232). The sleeve (260) at least partially defines the bore (238). The sleeve (260) further defines a port (262) that provides a path of fluid communication from the bore (238) to an exterior of the sleeve (260). The internal assembly (230) also includes a valve (270) configured to be positioned downstream from the port (262) in the sleeve (260).

20 Claims, 3 Drawing Sheets

(56) References Cited

U.S. PATENT DOCUMENTS

| | | | |
|---|---|---|---|
| 2004/0216883 | A1 | 11/2004 | Allen |
| 2012/0145402 | A1 | 6/2012 | Hilliard |
| 2016/0168939 | A1 | 6/2016 | Harris et al. |

OTHER PUBLICATIONS

Combined Search and Examination Report under Sections 17 and 18(3) in GB Patent Application No. GB2003288.4, dated May 13, 2020, 5 pages.

* cited by examiner

SYSTEM AND METHOD FOR REMOVING DEBRIS FROM A DRILLING FLUID

CROSS-REFERENCE TO RELATED APPLICATIONS

This application claims the benefit of, and priority to, UK Patent Application No. 2003288.4, filed Mar. 6, 2020 and titled "System and Method for Removing Debris from a Drilling Fluid", which application is expressly incorporated herein by this reference in its entirety.

BACKGROUND

A bottom hole assembly ("BHA") and drill bit provided at or near an end of a drill string are utilized to form a borehole in a subsurface formation during a drilling operation. The BHA may include various high-performance and/or highly sensitive elements. For example, the BHA often includes a rotary steerable system ("RSS"), a formation evaluation measurement tool, a direction and inclination measurement ("D&I") tool, a mud motor, a drill bit, a measuring-while-drilling ("MWD") tool, a logging-while-drilling ("LWD") tool, a power generation system (e.g., for the MWD tool, LWD tool, D&I tool, RSS tool, formation evaluation tool, or a combination thereof).

Magnetic, metallic, ferrous, and/or ferromagnetic debris (hereinafter "magnetic debris") is often present in a fluid, such as a drilling mud or fluid (hereinafter "drilling fluid") that is pumped through the drill string to the BHA. At least some of the magnetic debris may not be removed from the drilling fluid before the drilling fluid is pumped into the drill string to the BHA. If the magnetic debris flows into the BHA, the magnetic debris may restrict and/or damage the BHA. As a result of the restrictions and/or damage caused by the magnetic debris, the BHA may experience a reduction in efficiency and/or may become inoperable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An internal assembly for a tool is disclosed. The internal assembly includes a retainer that at least partially defines an axial bore. The retainer further defines a port providing a path of fluid communication from an exterior of the retainer to the bore. The internal assembly also includes an electromagnet coupled to the retainer. The electromagnet is configured to actuate between an on state and an off state and to attract magnetic debris in a fluid when in the on state. The internal assembly also includes a sleeve that is configured to be positioned downstream from the retainer. The sleeve at least partially defines the bore. The sleeve further defines a port that provides a path of fluid communication from the bore to an exterior of the sleeve. The sleeve is configured to actuate from a first position to a second position. The internal assembly also includes a valve configured to be positioned downstream from the port in the sleeve and to actuate from a first position to a second position.

A tool is also disclosed. The tool includes a body that defines a port. The tool also includes a retainer that is positioned at least partially within the body. An annulus is defined at least partially between the body and the retainer.

The retainer at least partially defines an axial bore. The retainer further defines a port that provides a path of fluid communication from the annulus to the bore. The tool also includes an electromagnet held by the retainer and configured to actuate between an on state and an off state. The tool also includes a sleeve positioned at least partially within the body and downstream from the port in the retainer. The sleeve at least partially defines the bore. The sleeve further defines a port. The sleeve is configured to actuate from a first position to a second position. The port in the sleeve is misaligned with the port in the body when the sleeve is in the first position, and the port in the sleeve is aligned with the port in the body when the sleeve is in the second position. The tool also includes a valve positioned at least partially within the body and downstream from the port in the sleeve. The valve is configured to actuate from a first position to a second position. The valve prevents fluid flow therethrough when in the first position, and the valve permits fluid flow therethrough when in the second position. The collecting tool is configured to have a drilling fluid flow in a downstream direction through the annulus, through the port in the retainer, and into the bore. When the electromagnet is in the on state, the sleeve is in the first position, and the valve is in the first position, the electromagnet is configured to attract magnetic debris in the drilling fluid such that the magnetic debris accumulates in the annulus, thereby producing a filtered drilling fluid that then flows through the port in the retainer, into the bore, and through the valve. When the electromagnet is in the off state, the sleeve is in the second position, and the valve is in the second position, the drilling fluid flushes the magnetic debris that has accumulated in the annulus through the port in the retainer, into the bore, and through the aligned ports in the sleeve and the body.

A method is also disclosed. The method includes running a tool into a borehole. The tool includes a body that defines a port. The tool also includes a retainer positioned at least partially within the body. An annulus is defined at least partially between the body and the retainer. The retainer at least partially defines an axial bore. The retainer further defines a port that provides a path of fluid communication from the annulus to the bore. The tool also includes an electromagnet held by the retainer. The tool also includes a sleeve positioned at least partially within the body and downstream from the port in the retainer. The sleeve at least partially defines the bore. The sleeve further defines a port. The tool also includes a valve positioned at least partially within the body and downstream from the port in the sleeve. The method also includes actuating the tool into a first state by actuating the electromagnet into an on state to attract magnetic debris, actuating the sleeve into a first position such that the port in the sleeve is misaligned with the port in the body, and actuating the valve into a first position to permit fluid flow therethrough. The method also includes pumping a drilling fluid through the tool when the tool is in the first state. When the tool is in the first state, the electromagnet is configured to attract the magnetic debris in the drilling fluid such that the magnetic debris accumulates in the annulus, thereby producing a filtered drilling fluid that then flows through the port in the retainer, into the bore, and through the valve.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
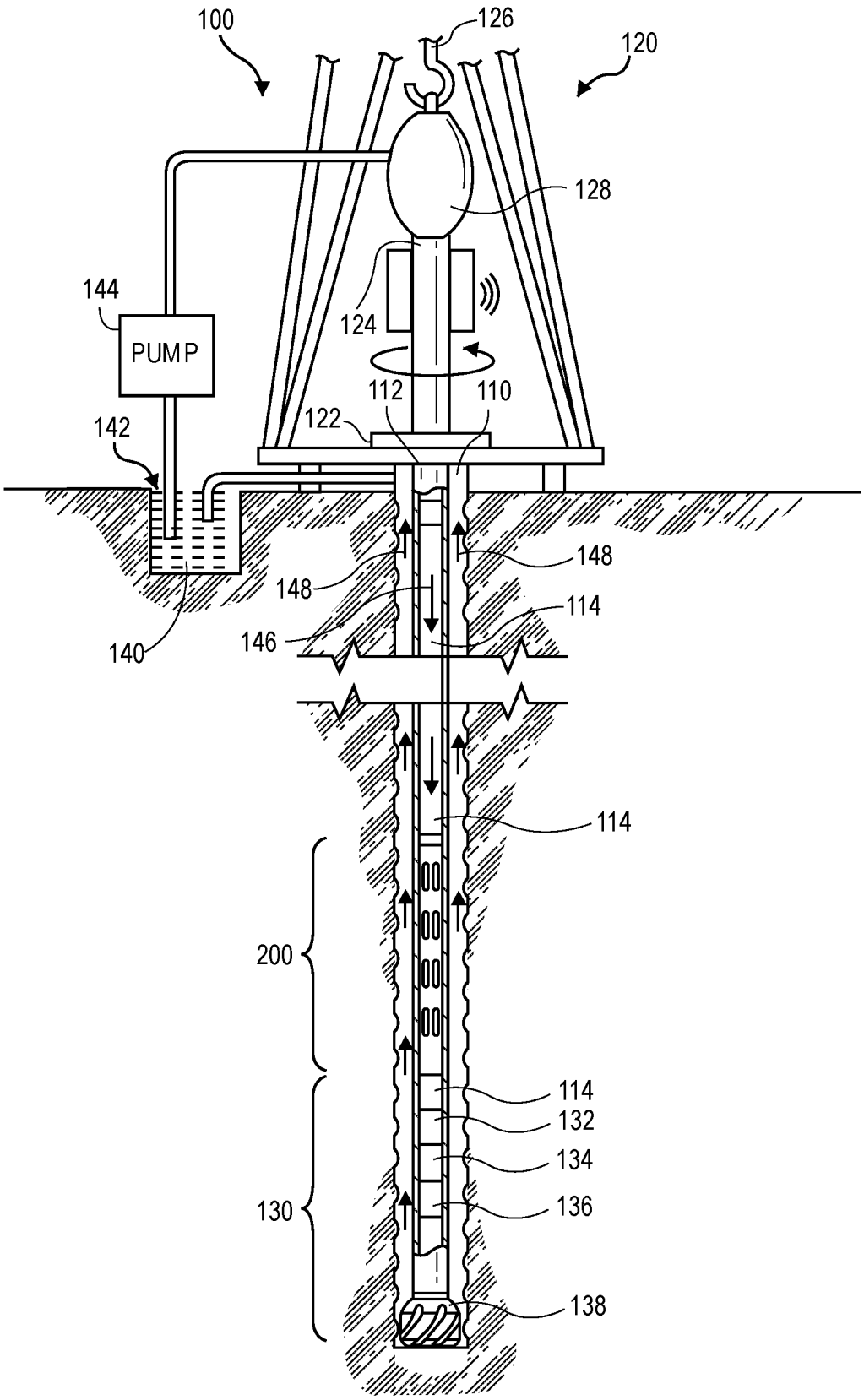
FIG. 1 illustrates a schematic view of an example of a drilling system including a tool, according to an embodiment.

Illustrative examples of the subject matter claimed below will now be disclosed. FIG. 1, for instance, illustrates a schematic view of an example of a drilling system 100, according to an embodiment. The drilling system 100 may be provided at a wellsite which may be an onshore or offshore wellsite, and the drilling system 100 may include any combination of the various elements described herein.

The drilling system 100 may form a borehole 110 in a subsurface formation by rotary drilling with a drill string 112 suspended within the borehole 110. The drill string 112 may be assembled from a plurality of segments 114 that may be or include pipe and/or collars. The drilling system 100 may include a platform and derrick assembly 120 positioned over the borehole 110. The platform and derrick assembly 120 may include a rotary table 122, a kelly 124, a hook 126, a rotary swivel 128, or a combination thereof. The drill string 112 may be rotated by the rotary table 122, which engages the kelly 124 at the upper end of the drill string 112. The drill string 112 may be suspended from the hook 126, and the rotary swivel 128 permits rotation of the drill string 112 relative to the hook 126. In another embodiment, a top drive system may be utilized instead of the rotary table 122 and/or the kelly 124 to rotate the drill string 112 from the surface above the borehole 110.

The drilling system 100 may also include a BHA 130 connected to a lower end of the drill string 112. The BHA 130 may include a LWD tool 132, a MWD tool 134, a motor 136, a drill bit 138, or a combination thereof. The drilling system 100 may further include a drilling fluid (e.g., mud) 140 stored in a pit 142 formed at the wellsite. A pump 144 may deliver the drilling fluid 140 to an interior of the drill string 112 via a port in the rotary swivel 128, which may cause the drilling fluid 140 to flow downwardly through the drill string 112 and into the BHA 130, as indicated by the directional arrow 146. The drilling fluid 140 may exit via ports in the drill bit 138, and then circulate upwardly through an annulus between an outside of the drill string 112 and a wall of the borehole 110, as indicated by directional arrows 148. The drilling fluid 140 may lubricate the drill bit 138 and/or may carry formation cuttings up to the surface adjacent to the borehole 110. The drilling fluid 140 may be returned to the pit 142 for cleaning and recirculation.

The drilling system 100 may also include a tool 200, which may be or include a downhole tool. The tool 200 may be run into the borehole 110 (e.g., using the drill string 112). For example, the tool 200 may be connected to the drill string 112, the BHA 130, or both. In the example shown, the tool 200 may be positioned above and/or upstream from the BHA 130.

As used herein, "above", "upper", and/or "upstream" refers to a side that is closer to the platform and derrick assembly 120, and "below", "lower" and/or "downstream" refers to a side that is closer to the BHA 130 and/or the bottom of the borehole 110. Thus, "upstream direction" refers to a direction that is toward the platform and derrick assembly 120, and "downstream direction" refers to a direction that is away from the platform and derrick assembly 120 and toward the BHA 130 and/or the bottom of the borehole 110.

As described in greater detail below, the tool 200 may have an internal assembly positioned at least partially therein. In one or more embodiments, the internal assembly may be or include a filtering tool. More particularly, the internal assembly may be or include a magnetic filtering tool that is configured to separate at least a portion of the magnetic debris from the drilling fluid 140, prior to the drilling fluid 140 flowing into the BHA 130. The tool 200 may collect and/or store the magnetic debris therein.

Collecting the magnetic debris in the tool 200 may prevent the magnetic debris or at least a portion of the magnetic debris from reaching and potentially damaging the BHA 130. In an embodiment, the tool 200 may reduce pressure loss across the drilling system 100 by collecting the magnetic debris. In another embodiment, the tool 200 may at least partially prevent the magnetic debris from interfering with any directional survey tools conducted in/by the BHA 130.

Figure 2:
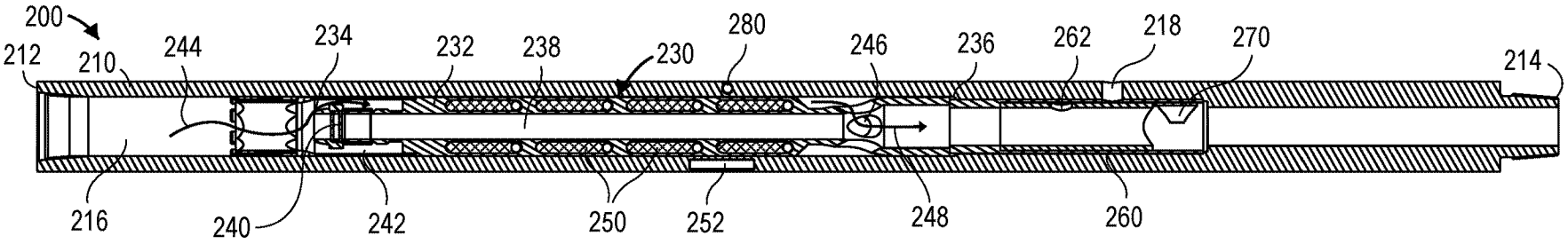
FIG. 2 illustrates a cross-sectional side view of an example of the tool in a first (e.g., filtering) state, according to an embodiment.

FIG. 2 illustrates a cross-sectional side view of an example of the tool 200 in a first (e.g., filtering) state, according to an embodiment. The tool 200 may include a substantially tubular body 210 having a first (e.g., upstream) end 212 and a second (e.g., downstream) end 214. The first end 212 may be connected to a segment 114 of the drill string 112 (see FIG. 1). The second end 214 may be connected to the BHA 130 or to a segment of the drill string 112 that is positioned between the tool 200 and the BHA 130. The body 210 may define an axial bore 216 that extends from the first end 212 to the second end 214. The body 210 may also define one or more radial ports (one is shown: 218) that provides a path of fluid communication (e.g., a flow path) from the bore 216 to an exterior of the body 210.

An internal assembly 230 may be positioned at least partially within the body 210 (e.g., within the bore 216). The internal assembly 230 may be configured to filter the magnetic debris from the drilling fluid 140 to reduce the amount of magnetic debris that flows out of the tool 200 via the second end 214 and into the BHA 130. The internal assembly 230 may include a retainer 232. The retainer 232 may include a first (e.g., upper) end 234 and a second (e.g., lower) end 236. The retainer 232 may at least partially define an axial bore 238 that extends from the first end 234 to the second end 236. The bore 238 of the retainer 232 may be in fluid communication with the bore 216 of the body 210. In one example, the bore 238 of the retainer 232 may be substantially concentric with the bore 216 of the body 210.

In at least one embodiment, the internal assembly 230 may also include a seal 240 that is coupled to the retainer 232 and/or positioned at least partially in the bore 238. The seal 240 may be configured to prevent the drilling fluid 140 from flowing through the bore 238. In the example shown, the seal 240 is positioned proximate to the first end 234 of the retainer 232 to prevent the drilling fluid 140 from flowing downstream through the bore 238 (e.g., to the right as shown in FIG. 2). The seal 240 is configured to be penetrated and/or broken by a second tool (e.g., a fishing tool) that may be run downhole. For example, a fishing tool may break the seal 240 and extend into and/or through bore 238 to reach a component inside the internal assembly 230 and/or below the internal assembly 230, such as the BHA 130.

The retainer 232 may be spaced apart from the body 210. More particularly, the first end 234 may be positioned radially inward from the body 210 such that an annulus 242 is formed between the retainer 232 and the body 210. The drilling fluid 140 may be prevented from flowing through the bore 238 of the retainer 232 by the seal 240. The drilling fluid 140 may instead flow downstream through the annulus 242, as shown by the arrow 244. The retainer 232 may define one or more radial ports 246 proximate to the second end 236 thereof. The drilling fluid 140 may flow in the downstream direction from the annulus 242, through the port 246, and into the bore 238 of the retainer 232, as shown by the arrow 248.

The internal assembly 230 may also include one or more magnets 250 that are configured to attract the magnetic debris in the drilling fluid 140. The magnets 250 may be connected to, positioned within, or otherwise held by the retainer 232. The magnets 250 may be axially offset and/or circumferentially offset from one another. One or more of the magnets 250 may be positioned at least partially between the seal 240 and the port 246 in the retainer 232.

In at least one embodiment, the magnets 250 may be permanent magnets. In another embodiment, the magnets 250 may be electromagnets. The electromagnets may be or include a type of magnet in which a magnetic field is produced by an electric current. The electromagnets may include wire wound into a coil. An electrical current through the wire creates the magnetic field. The magnetic field dissipates and/or disappears when the electrical current is turned off. Unlike permanent magnets, the electromagnets can be quickly changed by controlling the amount of electric current in the winding. As described in greater detail below, the magnetic debris may remain attracted to the magnets 250, and thus positioned/collected within the tool 200, as long as the electrical current is turned on and provided to the magnets 250.

The magnets 250 may be powered by one or more batteries (one is shown: 252). The battery 252 may be coupled to and/or positioned at least partially within the body 210, the retainer 232, or the BHA 130. In another embodiment, the magnets 250 may be powered by a power generation system. The power generation system may be coupled to and/or positioned at least partially within the body 210, the retainer 232, or the BHA 130. For example, the power generation system may be part of the BHA 130 and may include an impeller that is caused to rotate by the drilling fluid 140 flowing therethrough. The rotation of the impeller may be converted into electrical current, a portion of which may be transmitted to the magnets 250 via one or more wires.

The internal assembly 230 may also include a sleeve 260 positioned at least partially within the body 210 (e.g., within the bore 216). The sleeve 260 may be positioned downstream from the retainer 232. For example, the sleeve 260 may be positioned downstream from the port 246 in the retainer 232. In at least one embodiment, the sleeve 260 may be coupled to or integral with the retainer 232, and the retainer 232 and the sleeve 260 may be configured to move together within the body 210. In another embodiment, the sleeve 260 may not be coupled to or integral with the retainer 232, and the sleeve 260 may be configured to move with respect to the body 210 and the retainer 232. The sleeve 260 may define one or more radial ports (one is shown: 262). The sleeve 260 may be configured to actuate from/between a first position (see FIG. 2) and a second position (see FIG. 3). When the sleeve 260 is in the first position, the port 262 in the sleeve 260 may be misaligned with the port 218 in the body 210. Thus, the drilling fluid 140 may not flow through the ports 218, 262 to the exterior of the tool 200.

The internal assembly 230 may also include a valve 270. The valve 270 may be coupled to or part of the sleeve 260. The valve 270 may be positioned downstream from the port 218 in the body 210 and/or the port 262 in the sleeve 260. The valve 270 may be configured to actuate from/between a first (e.g., open) position (see FIG. 2) and a second (e.g., closed) position (see FIG. 3). When the valve 270 is in the open position, the drilling fluid 140 may flow therethrough. More particularly, the drilling fluid 140 that flows into the bore 238 via the port 246 may then flow downstream through the valve 270 and exit the tool 200 via the second end 214.

The tool 200 may be in the first (e.g., filtering) state when the magnets 250 are in an on state (e.g., electrical current is provided to the magnets 250), the sleeve 260 is in the first position (see FIG. 2), the valve 270 is in the first position (see FIG. 2), or a combination thereof. When the tool 200 is in the first state, drilling fluid 140 may enter the body 210 of the tool 200 via the first end 212. The drilling fluid 140 may flow downstream through the bore 216 of the body 210 toward the internal assembly 230. The drilling fluid 140 may be prevented from flowing into the bore 238 of the retainer 232 by the seal 240. The drilling fluid 140 may instead flow downstream through the annulus 242, as shown by the arrow 244. As the drilling fluid 140 passes the magnets 250 while flowing through the annulus 242, the magnetic debris may be attracted to the magnets 250 and thus separated (e.g., filtered) from the drilling fluid 140, thereby producing a filtered drilling fluid. The filtered drilling fluid 140 may then flow from the annulus 242, through the port 246, and into the bore 238 of the retainer 232. The filtered drilling fluid 140 may then flow through the valve 270 and out of the tool 200 through the second end 214 (e.g., toward/into the BHA 130). The drilling fluid 140 may not flow through the ports 218, 262 because the sleeve 260 is in the first position, causing the ports 218, 262 to be misaligned. As mentioned above, the magnetic debris may remain attracted to the magnets 250, and thus positioned/collected within the tool 200, as long as the magnets 250 are in the on state.

Figure 3:
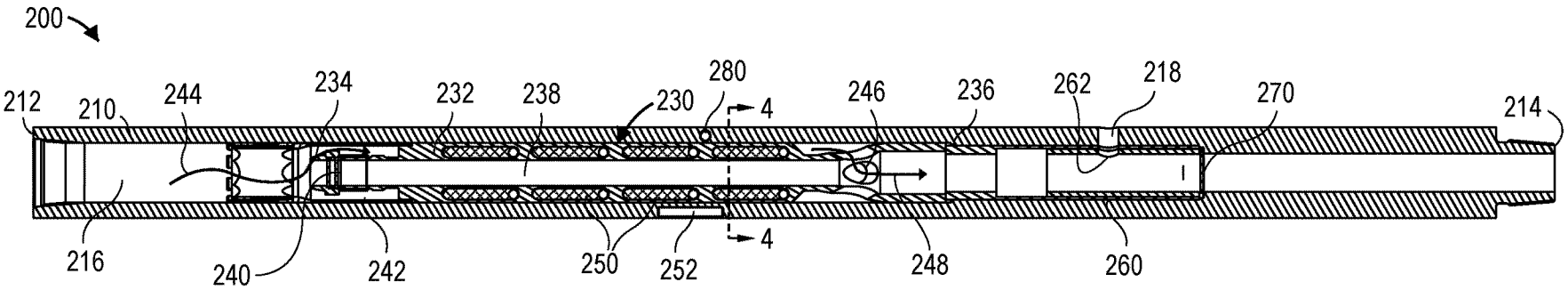
FIG. 3 illustrates a cross-sectional side view of the tool in a second (e.g., flushing) state, according to an embodiment.

FIG. 3 illustrates a cross-sectional side view of the tool 200 in a second (e.g., flushing) state, according to an embodiment. The magnetic debris may accumulate in the tool 200 when the tool 200 is in the first (e.g., filtering) state), which may restrict and eventually block the flow path through the tool 200. For example, the magnetic debris may accumulate in the annulus 242 when the tool 200 is in the first state, which may restrict and eventually block the flow path through the annulus 242 and/or the port 246. The tool 200 may be actuated in to the second state to flush the magnetic debris out of the tool 200.

The tool 200 may be in the second state when the magnets 250 are in an off state (e.g., electrical current is not provided to the magnets 250), the sleeve 260 is in the second position (see FIG. 3), the valve 270 is in the second position (see FIG. 3), or a combination thereof. When the tool 200 is in the second state, the drilling fluid 140 may enter the body 210 of the tool 200 via the first end 212. The drilling fluid 140 may flow downstream through the bore 216 of the body 210 toward the internal assembly 230. The drilling fluid 140 may be prevented from flowing in the bore 238 of the retainer 232 by the seal 240. The drilling fluid 140 may instead flow downstream through the annulus 242, as shown by the arrow 244.

As the magnets 250 are no longer in the on state (e.g., the electrical current is no longer provided to the magnets 250), the magnetic debris that has accumulated in the tool 200 may no longer be attracted to the magnets 250. Thus, the drilling fluid 140 flowing through the annulus 242 may flush the magnetic debris out of the annulus 242, through the port 246, and into the bore 238 of the retainer 232. With the valve 270 now in the closed position, the drilling fluid 140 (and the accumulated magnetic debris) may be prevented from flowing through the valve 270. However, the sleeve 260 may now be in the second position, which aligns the port 262 in the sleeve 260 with the port 218 in the body 210. The drilling fluid 140 (and the accumulated magnetic debris) may instead flow through the aligned ports 218, 262 to an exterior of the body 210. This may be an annulus between the tool 200 and a wall of the borehole 110. As a result, the magnetic debris may be flushed from the tool 200 and may not flow into the BHA 130.

Figure 4:
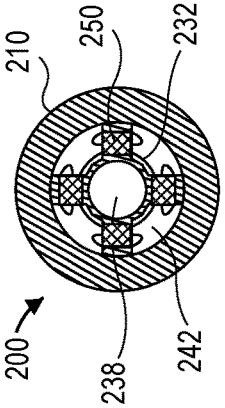
FIG. 4 illustrates a cross-sectional view of the tool taken through line 4-4 in FIG. 3, according to an embodiment.

FIG. 4 illustrates a cross-sectional view of the tool 200 taken through line 4-4 in FIG. 3, according to an embodiment. The magnets 250 may be circumferentially offset from one another. In the embodiment shown, there are four magnets 250 that are circumferentially offset from one another by about 90 degrees; however, the number of magnets 250 and the angle by which they are separated may vary. The retainer 232 and/or the magnets 250 may divide the annulus 242 into one or more portions. As shown, there are four portions of the annulus 242 through which the drilling fluid 140 may flow.

Figure 5:
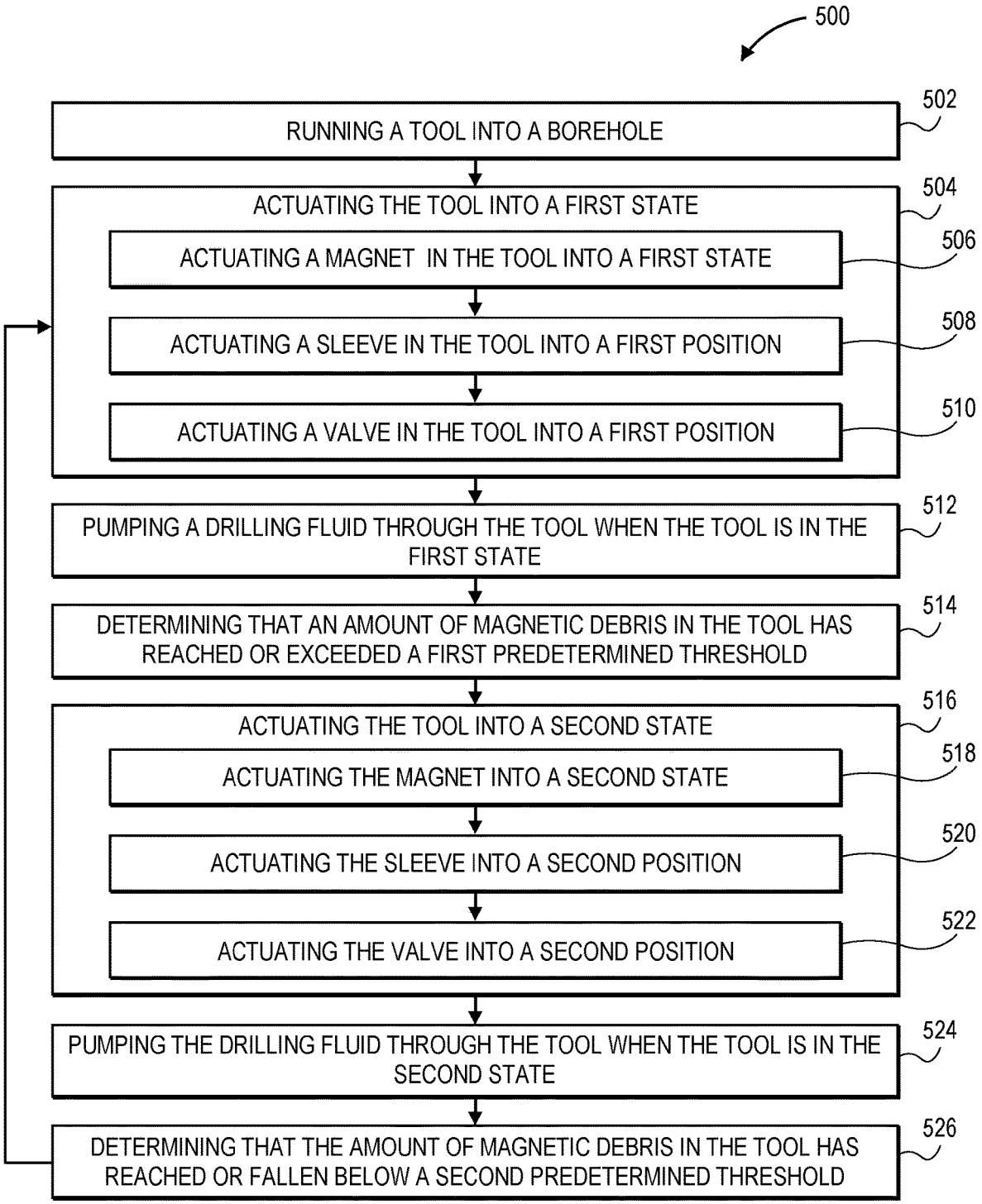
FIG. 5 illustrates a flowchart of a method for operating the tool, according to an embodiment.

FIG. 5 illustrates a flowchart of a method 500 for operating the tool 200, according to an embodiment. An illustrative order of the method 500 is provided below; however, one or more portions of the method 500 may be performed in a different order, repeated, or omitted altogether.

The method 500 may include running the tool 200 into the borehole 110, as at 502. As mentioned above, the tool 200 may be run into the borehole 110 on the drill string 112, and the tool 200 may be positioned above and/or upstream from the BHA 130.

The method 500 may also include actuating the tool 200 into the first (e.g., filtering) state, as at 504. Actuating the tool 200 into the first state may include actuating the magnets 250 into the first (e.g., on) state, as at 506. This may include providing the electrical current to the magnets 250, which causes the magnets 250 to generate the magnetic field. In one embodiment, the magnets 250 may be actuated by a shifting tool that is run into the borehole 110 from the surface. In another embodiment, the magnets 250 may be actuated by an actuator that is coupled to and/or positioned within the tool 200 or the BHA 130. The actuator may operate on a timer, or the actuator may be configured to actuate the magnets 250 in response to a user command from the surface. In another embodiment, the magnets 250 may be actuated by varying a pressure of the drilling fluid 140. In yet another embodiment, the magnets 250 may be actuated into the first state at the surface before the tool 200 is run into the borehole 110.

Actuating the tool 200 into the first state may also include actuating the sleeve 260 into the first position (see FIG. 2), as at 508. As mentioned above, the ports 218, 262 may be misaligned when the sleeve 260 is in the first position, such that the drilling fluid 140 may not flow therethrough. In one embodiment, the sleeve 260 may be actuated by a shifting tool that is run into the borehole 110 from the surface. In another embodiment, the sleeve 260 may be actuated by an actuator that is coupled to and/or positioned within the tool 200 or the BHA 130. The actuator may operate on a timer, or the actuator may be configured to actuate the sleeve 260 in response to a user command from the surface. In another embodiment, the sleeve 260 may be actuated by varying a pressure of the drilling fluid 140. In yet another embodiment, the sleeve 260 may be actuated into the first position at the surface before the tool 200 is run into the borehole 110.

Actuating the tool 200 into the first state may also include actuating the valve 270 into the first position, as at 510. As mentioned above, the valve 270 may be open when the valve 270 is in the first position, such that the drilling fluid 140 may flow downstream therethrough. In one embodiment, the valve 270 may be actuated by a shifting tool that is run into the borehole 110 from the surface. In another embodiment, the valve 270 may be actuated by an actuator that is coupled to and/or positioned within the tool 200 or the BHA 130. The actuator may operate on a timer, or the actuator may be configured to actuate the valve 270 in response to a user command from the surface. In another embodiment, the valve 270 may be actuated by varying a pressure of the drilling fluid 140. In yet another embodiment, the valve 270 may be actuated into the first position at the surface before the tool 200 is run into the borehole 110.

The method 500 may also include pumping the drilling fluid 140 through the tool 200 when the tool 200 is in the first state, as at 512. More particularly, the pump 144 may cause the drilling fluid 140 to flow from the pit 142, through the drill string 112, and into the tool 200. When the tool 200 is in the first state, the drilling fluid 140 may enter the body 210 of the tool 200 via the first end 212. The drilling fluid 140 may flow downstream through the bore 216 of the body 210 toward the internal assembly 230. The drilling fluid 140 may be prevented from flowing into the first end 234 of the bore 238 of the retainer 232 by the seal 240. The drilling fluid 140 may instead flow downstream through the annulus 242, as shown by the arrow 244. As the drilling fluid 140 passes the magnets 250 while flowing through the annulus 242, the magnetic debris may be attracted to the magnets 250 and thus separated from the drilling fluid 140, thereby producing a filtered drilling fluid. The filtered drilling fluid may then flow from the annulus 242, through the port 246, and into the bore 238 of the retainer 232. The filtered drilling fluid may then flow through the valve 270 and out of the tool 200 via the second end 214. The filtered drilling fluid may then flow into the BHA 130. The filtered drilling fluid may not flow through the ports 218, 262 because the sleeve 260 is in the first position, causing the ports 218, 262 to be misaligned. As mentioned above, the magnetic debris may remain attracted to the magnets 250, and thus positioned within the tool 200, as long as the magnets 250 are in the first state.

The method 500 may also include determining that an amount of magnetic debris in the tool 200 has reached or exceeded a first predetermined threshold, as at 514. In one embodiment, a sensor 280 may be coupled to and/or positioned at least partially within the tool 200 that is configured to determine the amount of magnetic debris in the tool 200. The sensor 280 may be or include a proximity sensor that is configured to determine when the accumulation of magnetic debris moves to within a predetermined distance from the sensor 280. The sensor 280 may also or instead be or include a flow rate sensor that is configured to measure the flow rate of the drilling fluid 140 through the tool 200 (e.g., through the annulus 242, the port 246, and/or the valve 270). As the magnetic debris accumulates, this may constrict the flow path, which may increase the flow rate of the drilling fluid 140. The sensor 280 may also or instead be or include a pressure sensor that is configured to measure the pressure of the drilling fluid 140 in the tool 200. In another embodiment, the sensor 280 may be positioned at the surface (e.g., coupled to the pump 144).

The method 500 may also include actuating the tool 200 into the second (e.g., flushing) state, as at 516. As mentioned above, the magnetic debris that has accumulated in the tool 200 when the tool is in the first state may be flushed out of the tool 200 when the tool 200 is in the second state. In one embodiment, the tool 200 may be actuated into the second state in response to the determination that the amount of magnetic debris in the tool 200 has reached or exceeded a first predetermined threshold. In another embodiment, the tool 200 may be actuated into the second state in response to a timer. For example, the tool 200 may actuate into the second state after operating in the first state for 30 minutes.

Actuating the tool 200 into the second state may also include actuating the magnets 250 into the second (e.g., off) state, as at 518. This may include ceasing to provide the electrical current to the magnets 250, which causes the magnetic field to dissipate. The magnets 250 may be actuated in the same manner as described above.

Actuating the tool 200 into the second state may also include actuating the sleeve 260 into the second position (see FIG. 3), as at 520. As mentioned above, the ports 218, 262 may be aligned when the sleeve 260 is in the second position, such that the drilling fluid 140 and the magnetic debris being flushed may flow therethrough (e.g., into an annulus between the tool 200 and a wall of the borehole 110). Thus, the drilling fluid 140 and the magnetic debris may bypass the BHA 130. The sleeve 260 may be actuated in the same manner as described above.

Actuating the tool 200 into the second state may also include actuating the valve 270 into the second position, as at 522. As mentioned above, the valve 270 may be closed when the valve 270 is in the second position, such that the drilling fluid 140 may not flow therethrough. The valve 270 may be actuated in the same manner as described above.

The method 500 may also include pumping the drilling fluid 140 through the tool 200 when the tool 200 is in the second state, as at 524. More particularly, the pump 144 may cause the drilling fluid 140 to flow from the pit 142, through the drill string 112, and into the tool 200. When the tool 200 is in the second state, the drilling fluid 140 may enter the body 210 of the tool 200 via the first end 212. The drilling fluid 140 may flow downstream through the bore 216 of the body 210 toward the internal assembly 230. The drilling fluid 140 may be prevented from flowing into the first end 234 of the bore 238 of the retainer 232 by the seal 240. The drilling fluid 140 may instead flow downstream through the annulus 242, as shown by the arrow 244.

As the magnets 250 are now in the second state (e.g., the electrical current is no longer provided to the magnets 250), the magnetic debris that has accumulated in the tool 200 may no longer be attracted to the magnets 250. Thus, the drilling fluid 140 flowing through the annulus 242 may flush the magnetic debris out of the annulus 242, through the port 246, and into the bore 238 of the retainer 232. With the valve 270 now in the second position, the drilling fluid 140 and the accumulated magnetic debris may be prevented from flowing through the valve 270 toward the BHA 130. However, with the sleeve 260 now in the second position, which aligns the port 262 in the sleeve 260 with the port 218 in the body 210, the drilling fluid 140 and the accumulated magnetic debris may instead flow through the aligned ports 218, 262 to an exterior of the body 210. This may be an annulus between the tool 200 and a wall of the borehole 110. As a result, the magnetic debris may be flushed from the tool 200 and may not flow into the BHA 130. Thus, the tool 200 may be configured to flush the magnetic debris out of the tool 200 while the tool 200 remains in the borehole 110. This is in contrast to conventional tools that are pulled out of the borehole 110 to remove the magnetic debris and then run back into the borehole 110 to resume filtering.

The method 500 may also include determining that the amount of magnetic debris in the tool 200 has reached or fallen below a second predetermined threshold, as at 526. In one embodiment, this determination may be made by the sensor 280, as described above.

The method 500 may then loop back around and include actuating the tool 200 (back) into the first state, as at 504. This may be done in the same manner as described above (e.g., using a shifting tool, actuator, etc.). In one embodiment, the tool 200 may be actuated back into the first state in response to the determination that the amount of magnetic debris in the tool 200 has reached or fallen below the second predetermined threshold. In another embodiment, the tool 200 may be actuated back into the first state in response to a timer. For example, the tool 200 may actuate back into the first state after flushing in the second state for 1 minute.

The foregoing description, for purposes of explanation, used specific nomenclature to provide a thorough understanding of the disclosure. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

As used herein, the terms "couple", "coupled", "connect", "connection", "connected", "in connection with", and "connecting" refer to "in direct connection with" or "in connection with via one or more intermediate elements or members". Further, as used herein, the article "a" is intended to have its ordinary meaning in the patent arts, namely "one or more". Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

It will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. An internal assembly for a tool, the internal assembly comprising:

a retainer that at least partially defines an axial bore, the retainer further defining a port providing a path of fluid communication from an exterior of the retainer to the bore;

an electromagnet coupled to the retainer, the electromagnet configured to actuate between an on state and an off state and to attract magnetic debris in a fluid when in the on state;

a sleeve configured to be positioned downstream from the retainer, the sleeve at least partially defining the bore, the sleeve further defining a port that provides a path of fluid communication from the bore to an exterior of the sleeve, and the sleeve being configured to actuate from a first position to a second position; and a valve configured to be positioned downstream from the port in the sleeve and to actuate from a first position to a second position.

2. The internal assembly of claim 1, further comprising a seal positioned at least partially within the bore, the seal being positioned upstream from the port in the retainer and the electromagnet, and the seal being configured to prevent the fluid from flowing in a downstream direction through the bore between the seal and the port in the retainer.

3. The internal assembly of claim 2, wherein the electromagnet is positioned at least partially between the seal and the port in the retainer, the electromagnet being configured to attract the magnetic debris outside of the bore when the electromagnet is in the on state.

4. The internal assembly of claim 3, wherein the port in the retainer is positioned at least partially between the electromagnet and the port in the sleeve.

5. The internal assembly of claim 1, wherein the fluid is prevented from flowing through the port in the sleeve when the sleeve is in the first position, and the port in the sleeve is configured to permit the fluid flow therethrough, from the bore to the exterior of the sleeve, when the sleeve is in the second position.

6. The internal assembly of claim 5, wherein the valve is configured to permit the fluid flow therethrough in a downstream direction when the valve is in the first position, and the valve is configured to prevent the fluid from flowing therethrough when the valve is in the second position.

7. The internal assembly of claim 1, wherein the sleeve and the valve are configured to permit the fluid to flow through the sleeve and the valve in a downstream direction, and to prevent the fluid from flowing through the port in the sleeve when the sleeve is in the first position and the valve is in the first position.

8. The internal assembly of claim 7, wherein the sleeve and the valve are configured to cause the fluid to flow through the port in the sleeve, and to prevent the fluid from flowing through the valve in the downstream direction when the sleeve is in the second position and the valve is in the second position.

9. The internal assembly of claim 1, when the electromagnet is in the on state, the sleeve is in the first position, and the valve is in the first position, the electromagnet is configured to attract the magnetic debris such that the magnetic debris accumulates outside of the bore, thereby producing a filtered fluid, the filtered fluid then flowing through the port in the retainer into the bore, and through the valve, and the filtered fluid is prevented from flowing through the port in the sleeve.

10. The internal assembly of claim 9, wherein, when the electromagnet is in the off state, the sleeve is in the second position, and the valve is in the second position, the fluid flushes the magnetic debris that has accumulated outside of the bore through the port in the retainer, into the bore, and through the port in the sleeve, and the fluid and the magnetic debris are prevented from flowing through the valve.

11. A tool comprising:

a body that defines a port;

a retainer positioned at least partially within the body, an annulus being defined at least partially between the body and the retainer, the retainer at least partially defining an axial bore, and the retainer further defining a port that provides a path of fluid communication from the annulus to the bore;

an electromagnet held by the retainer and configured to actuate between an on state and an off state;

a sleeve positioned at least partially within the body and downstream from the port in the retainer, the sleeve at least partially defining the bore, the sleeve further defining a port, the sleeve being configured to actuate from a first position to a second position, the port in the sleeve being misaligned with the port in the body when the sleeve is in the first position, and the port in the sleeve being aligned with the port in the body when the sleeve is in the second position; and a valve positioned at least partially within the body and downstream from the port in the sleeve, the valve being configured to actuate from a first position to a second position, the valve preventing fluid flow therethrough when in the first position, and the valve permitting fluid flow therethrough when in the second position, wherein:

the collecting tool is configured to have a drilling fluid flow in a downstream direction through the annulus, through the port in the retainer, and into the bore, when the electromagnet is in the on state, the sleeve is in the first position, and the valve is in the first position, the electromagnet is configured to attract magnetic debris in the drilling fluid such that the magnetic debris accumulates in the annulus, thereby producing a filtered drilling fluid that then flows through the port in the retainer, into the bore, and through the valve, and when the electromagnet is in the off state, the sleeve is in the second position, and the valve is in the second position, the drilling fluid flushes the magnetic debris that has accumulated in the annulus through the port in the retainer, into the bore, and through the aligned ports in the sleeve and the body.

12. The tool of claim 11, further comprising a seal positioned at least partially within the bore, the seal being positioned upstream from the port in the retainer and the electromagnet, and the seal being configured to prevent the drilling fluid from flowing in the downstream direction through the bore between the seal and the port in the retainer.

13. The tool of claim 12, wherein the filtered drilling fluid is prevented from flowing through the port in the sleeve and the port in the body when the electromagnet is in the on state, the sleeve is in the first position, and the valve is in the first position.

14. The tool of claim 13, wherein the drilling fluid and the magnetic debris are prevented from flowing through the valve when the electromagnet is in the off state, the sleeve is in the second position, and the valve is in the second position.

15. The tool of claim 14, wherein the electromagnet, the sleeve, and the valve are configured to actuate in response to a timer.

16. A method, comprising:

running a tool into a borehole, wherein the tool comprises:

a body that defines a port;

a retainer positioned at least partially within the body, an annulus being defined at least partially between the body and the retainer, the retainer at least partially defining an axial bore, and the retainer further defining a port that provides a path of fluid communication from the annulus to the bore;

an electromagnet held by the retainer;

a sleeve positioned at least partially within the body and downstream from the port in the retainer, the sleeve at least partially defining the bore, and the sleeve further defining a port; and a valve positioned at least partially within the body and downstream from the port in the sleeve;

actuating the tool into a first state by:

actuating the electromagnet into an on state to attract magnetic debris;

actuating the sleeve into a first position such that the port in the sleeve is misaligned with the port in the body; and actuating the valve into a first position to permit fluid flow therethrough; and pumping a drilling fluid through the tool when the tool is in the first state, wherein, when the tool is in the first state, the electromagnet is configured to attract the magnetic debris in the drilling fluid such that the magnetic debris accumulates in the annulus, thereby producing a filtered drilling fluid that then flows through the port in the retainer, into the bore, and through the valve.

17. The method of claim 16, further comprising actuating the tool into a second state by:

actuating the electromagnet into an off state such that the electromagnet does not attract the magnetic debris;

actuating the sleeve into a second position such that the port in the sleeve is aligned with the port in the body; and actuating the valve into a second position to prevent fluid flow therethrough.

18. The method of claim 17, wherein, when the tool is in the second state, the drilling fluid flushes the magnetic debris that has accumulated in the annulus through the port in the retainer, into the bore, and through the aligned ports in the sleeve and the body.

19. The method of claim 18, further comprising determining that an amount of the magnetic debris that has accumulated in the annulus has reached or exceeded a predetermined threshold, and wherein actuating the tool into the second state is in response to determining that the amount of the magnetic debris that has accumulated in the annulus has reached or exceeded the predetermined threshold.

20. The method of claim 18, wherein actuating the tool into the first state and the second state is in response to a timer, wherein the tool operates in the first state for a greater amount of time than the tool operates in the second state.

* * * * *